US005410968A

United States Patent [19]

Hawthorne et al.

[11] Patent Number: 5,410,968

[45] Date of Patent: May 2, 1995

[54] LIGHTWEIGHT FATIGUE RESISTANT RAILCAR TRUCK SIDEFRAME WITH TAPERING I-BEAM CONSTRUCTION

[75] Inventors: V. Terrey Hawthorne, Lisle; Donald J. Marlborough, Libertyville; Rami V. Nassar, Chicago, all of Ill.

[73] Assignee: Amsted Industries Incorporated, Chicago, Ill.

[21] Appl. No.: 131,143

[22] Filed: Oct. 4, 1993

[51] Int. Cl.[6] ..... B61F 5/52

[52] U.S. Cl. ..... 105/206.1

[58] Field of Search ..... 105/206.1, 206.2

[56] References Cited

U.S. PATENT DOCUMENTS

| | | | |
|---|---|---|---|
| 2,186,008 | 1/1940 | Chapman | 105/206.1 |
| 2,930,329 | 3/1960 | Bush | 105/206.1 |
| 3,000,330 | 9/1961 | Shafer | 105/206.1 |
| 3,754,514 | 8/1973 | Peterson | 105/206.1 X |
| 4,424,750 | 1/1984 | Tilly et al. | 105/206.1 |

OTHER PUBLICATIONS

Car Builder's Cyclopedia, Simmons-Boardman Publishing Corp., 197, pp. 627, 629.

Railway Mechanical Engineering-A Century of Progress, Car & Locomotive Design, The American Society of Mechanical Engineers, pp. 337-355.

*Primary Examiner*—Robert J. Oberleitner

*Assistant Examiner*—S. Joseph Morano

*Attorney, Agent, or Firm*—Edward J. Brosius; F. S. Gregorczyk; Thomas J. Schab

[57] ABSTRACT

The sideframe of a railway car truck are constructed such that basic overall sideframe appearance is maintained, but the actual construction results in a more efficient use of the materials as a way of reducing the sideframe weight. This means that material is used according to how the stresses are encountered by the sideframe, dictating that the sideframe midsection is structurally heavier than the sideframe ends. Maximization of this construction is provided by shaping the entire sideframe into a solid, unitary cross-sectional I-beam shape. A solid top flange of the I-beam corresponds to the typical top compression member while the solid bottom flange corresponds to the typical bottom compression member. The solid vertical web, which interconnects the top and bottom flanges is a typical, thereby allowing the web to absorb forces which would normally have to be absorbed by either top or bottom member. This feature allows the sideframe to be lighter, yet structurally stronger because the top and bottom members can now be cast dimensionally smaller. To take advantage of the weight savings even further, the I-beam shape has a structurally tapering thickness from the midsection to the ends and this corresponds to the loading experienced by the sideframe. The open, I-beam exterior allows for easier and more reliable inspection, as well as improved casting quality due to a substantial reduction in casting core usage.

4 Claims, 3 Drawing Sheets

SECTION B-B

SECTION C-C

LIGHTWEIGHT FATIGUE RESISTANT RAILCAR TRUCK SIDEFRAME WITH TAPERING I-BEAM CONSTRUCTION

FIELD OF THE INVENTION

This invention relates to an improved railcar truck and more particularly to a lightweight sideframe for a three piece freight car truck.

BACKGROUND OF THE INVENTION

The more prevalent freight railcar construction in the United States includes what are known as three-piece trucks. Trucks are wheeled structures that ride on tracks and two such trucks are normally used beneath each railcar body, one truck at each end. The "three-piece" terminology refers to a truck which has two sideframes that are positioned parallel to the wheels and the rails, and to a single bolster which transversely spans the distance between the sideframes. The weight of the railcar is generally carried by a center plate connected at the midpoint of each of the bolsters.

Each cast steel sideframe is usually a single casting comprised of an elongated lower tension member interconnected to an elongated top compression member which has pedestal jaws on each end. The jaws are adapted to receive the wheel axles which extend transversely between the spaced sideframes. Usually, a pair of longitudinally spaced internal support columns vertically connects the top and bottom members together to form a bolster opening which receives the truck bolster. The bolster is typically constructed as single cast steel section and each end of the bolster extends into each of the sideframe bolster openings. Each end of the bolster is then supported by a spring group that rests on a horizontal extension plate projecting from the bottom tension member.

Railcar trucks must operate in severe environments where the static loading can be magnified, therefore, they must be structurally strong enough to support the car and the car payload, as well as the weight of its own structure. The trucks themselves are heavy structural components which contribute to a substantial part of the total tare weight placed upon the rails. Since the rails are typically regulated by the railroads, who are concerned with the reliability and the wear conditions of their tracks, the maximum quantity of product that a shipper may place within a railcar will be directly affected by the weight of the car body, including the trucks themselves. Hence, any weight reduction that may be made in the truck components will be available for increasing the carrying capacity of the car.

The designers of the early cast steel trucks experimented with several types of cross sections in their quest to reduce sideframe weight, but were unable to develop a successful "open" cross section. In fact, the efforts were so unsuccessful that, to this day, the Association of American Railroads (AAR) prohibits open section sideframes. Modern cast steel sideframes currently used in the three-piece truck configurations are designed with cross sections having either a box or C-shape. To produce these cross sections, numerous cores must be used in the molding process, but the use of cores increases production costs and complicates the pouring process by adding complex channels inside the mold which must be filled with molten metal.

Fabricated sideframes were later experimented with, and they were seen as a revolutionary light weight replacement for the cast sideframe. However, the presence of welds in the fabricated sideframes were found to reduce fatigue life and hence, structural integrity of the sideframe, as compared to the cast structures. As a result of the low service life for fabricated sideframes, interest in the cast steel sideframes continued, but in order to improve the fatigue life, it became necessary to increase the structural cross-sectional thicknesses, which is a negative focus for obvious reasons.

Another problem hindering the development of lighter, yet stronger sideframes was the fact that structural development of a cast steel sideframe design is extremely expensive and prior to the modern computer, the load paths on a sideframe could only be valuated after producing an expensive pattern and then pouring a test sample piece. Typically, the manufacturing process required several samples to be cast in order to produce a single part acceptable for testing. Furthermore, the loading tests which predict sideframe structural integrity are expensive and only a few machines exist which are officially approved by the AAR for verification purposes; one of those being at the ASF lab in Granite City, Ill. Nevertheless, even after all of the developmental stages have been completed, the AAR must still approve the design change. This process can take months, even years, for a complex design change. Therefore, it is not surprising that innovation in the railroad industry has proceeded slowly in the freight car truck design area. In spite of these handicaps, new analytical tools and a genuine need to help the railroads reduce costs is now at hand.

However, with the great strides made in development of computer technology, advanced engineering analysis has allowed designers to challenge these principles and to design car members which are actually stronger, yet lighter, than past designs. These latest techniques have increased the focus of attention towards maximizing the carrying capacity of the car while reducing the energy consumption realized from weight reductions in the railcar components.

SUMMARY OF THE INVENTION

Accordingly, it is an object of the present invention to reduce the weight of a railcar truck sideframe casting by efficiently utilizing the material such that an increase in the strength to weight ratio can be realized.

It is another object of the present invention to reduce the weight of the sideframes while reducing the stress concentrations at the critical areas of the railcar truck sideframe. The present invention accomplishes this by providing the basic design of the sideframe with a special I-cross sectional shape and a vertical web. A portion of the web is removed to reduce the weight, however, the flanges of the I-beam shaped casting are given generous radii on the outside edges. The larger radii blend the joining surfaces, thereby enhancing the process of "feeding" the molten metal into the casting. The improved feeding reduces the stress concentrations and resultant fatigue problems which normally form at the abrupt sectional changes, and it also reduces the amount of metal, casting time, and finishing labor associated with the old casting process. In addition, the larger radii also permits easier release of the pattern from the mold where the flange meets the web.

It is also very important to understand that the present invention provides added inspectional capabilities when compared to the closed, tubular structure of prior art sideframes. With the solid, yet "open" I-beam structure, all sideframe surfaces are openly in plain view for easy inspection. With prior art sideframes, the closed structural design meant that inside surfaces were never in plain view and could never be visually inspected. With the present solid I-beam design, casting flaws and surface irregularities can be detected immediately after casting, permitting repairs before they are put into service. The solid, open design of the present invention also has the advantage of easily being tested both visually and non-destructively, for signs of fatigue cracking after they have been in service. Being able to visually see every surface leads to early detection of problems which lends itself to keeping the rail lines operating safely without catastrophic failure.

Furthermore, the solid, open sideframe of the present design also provides economical advantages which have large effects on production costs, finishing costs, shipping costs and in-service operational costs. For example, the solid I-beam design significantly reduces the number of required casting cores from 18 down to only 6. Not only do fewer cores save substantial material and labor costs, they save production casting time since the flow of metal throughout the mold is faster and more continuous due to the intricate bends and turns having been eliminated. Eliminating cores also reduces casting problems associated with poor quality. The casting induced stresses, which have a substantial impact on sideframe fatigue life, are substantially lessened since casting turbulences caused by restrictive core ports are virtually eliminated. Furthermore, casting dimensions become more uniform with fewer cores, meaning that the mold cooling rates also become more uniform, thereby eliminating the possibility of hot tears and cooling induced stresses.

Besides the great cost savings in the casting process, the present invention also requires substantially less finishing time because there are less sprues left behind when the sideframe is removed from the mold; sprues are caused by metal leaking between cores. Even the amount of finishing welding is reduced because there is no surface which cannot be easily reached, making each sideframe almost assured the opportunity of being repaired and used, instead of scrapping the sideframe if it is determined that finish welding is too substantial or too hard to reach.

In addition to the great economic production savings, this new sideframe design can also save shipping costs because each sideframe weighs about 200–250 pounds less than prior art sideframes. Therefore, more finished sideframes can be shipped per load, thereby reducing shipping costs. Railroads can also save operating costs per mile by being able to convert the weight savings gained by a lighter truck assembly into a corresponding gain in additional payload carried. This also equates to fuel savings if the weight reduction is not offset by increased payload weight.

Briefly stated, the present invention primarily involves reduction of metal in all non-critical areas in order to reduce the weight of the sideframe, plus it involves reduction of the number of cores used in the casting process, which in turn, directly improves the feeding and solidification process involved with the casting. Since the majority of test or service problems associated with a sideframe are the result of either casting imperfections or design stress concentrations, this invention will significantly reduce the sort of imperfections that lead to fatigue cracking, thereby producing a lighter, stronger sideframe. Since the sideframe is a structure prone to fatigue problems, any improvement in the fatigue-prone sites will result with a better casting. The improved manufacturing process brought about by the light weight design will produce fewer fatigue-prone sites by providing a smooth flow of metal throughout the casting. The less complicated flow pattern will reduce the stresses that concentrate in an area and lead to casting imperfections; this will reduce the possibility for hot tears and lead to an increased fatigue life for the sideframe.

BRIEF DESCRIPTION OF THE DRAWINGS

Other objects and advantages of the present invention will become apparent from the following detailed descriptions taken in conjunction with the drawings wherein.

DESCRIPTION OF THE PREFERRED EMBODIMENT

Figure 1:
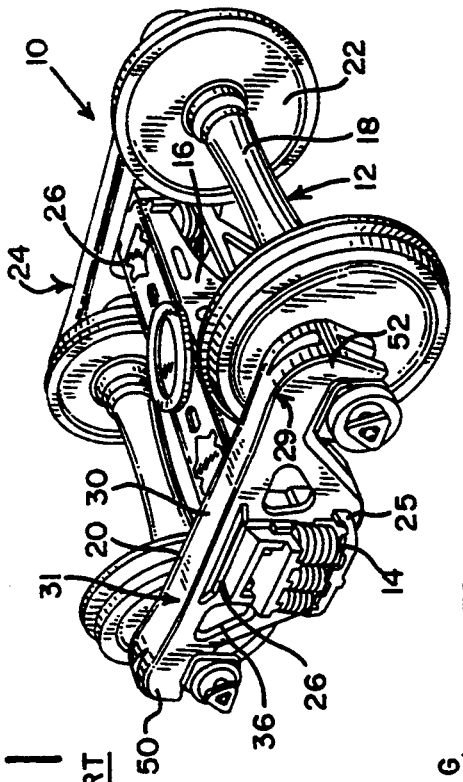
FIG. 1 PRIOR ART
FIG. 1 is a perspective view of a railway truck.

Referring now to FIG. 1 there is shown a railway vehicle truck 10 common to the railroad industry. Truck 10 comprises generally a pair of longitudinally spaced wheel sets 12, each set including an axle 18 with laterally spaced wheels 22 attached at each end of the axles 18 in the standard manner.

A pair of transversely spaced sideframes 20, 24 are mounted on the wheel sets 12. Sideframes 20,24 each include a bolster opening 26, respectively, in which there are supported by means of spring sets 14, a bolster 16. Bolster 16 extends laterally between each sideframe 20,24 and generally carries the weight of the railcar. Upon movement in the vertical direction, bolster 16 is sprung by spring sets 14 which are attached to a spring seat plate 25 at the bottom of sideframes 20,24. The bolster is of substantially standard construction and will not be discussed.

It is known in the art that the principal cause of failure in a sideframe member is metal fatigue caused by tension induced stresses which largely concentrate in the bend corners and at any anomalies in the cast metal, such as abrupt cross-sectional reductions, casting flaws, abrupt bends, offsets, and even mold or core sand pit surface marks. The retention of casting chaplets in the metal is another source of stress concentration. Chaplets are known to those in the art to be small metal spacers that accurately position the core components within the mold flasks so as to properly space the core and mold surfaces from each other in order to arrive at the desired metal thickness in the resultant casting. Ideally, the chaplets completely melt and become indistinguishable from the cast metal, although many times they do not, thereby causing an accumulation of casting induced stresses. Reducing the number of cores reduces the number of chaplets.

As previously mentioned, historical design considerations for addressing the sideframe compressive and tensile stress problems have largely involved increasing the cross-sectional thicknesses of the top and bottom members without regard to weight. In that respect, the sideframe of the present invention has been thoroughly analyzed with respect to the static and dynamic loading problems which are common to all three piece trucks, resulting in a re-designed sideframe which is functionally stronger, yet uses less metallic mass; hence the structure of the sideframe of the present invention is constructed as an open, yet solid, I-beam, having a typical payload-to-weight ratio of about 11:1.

Figure 2:
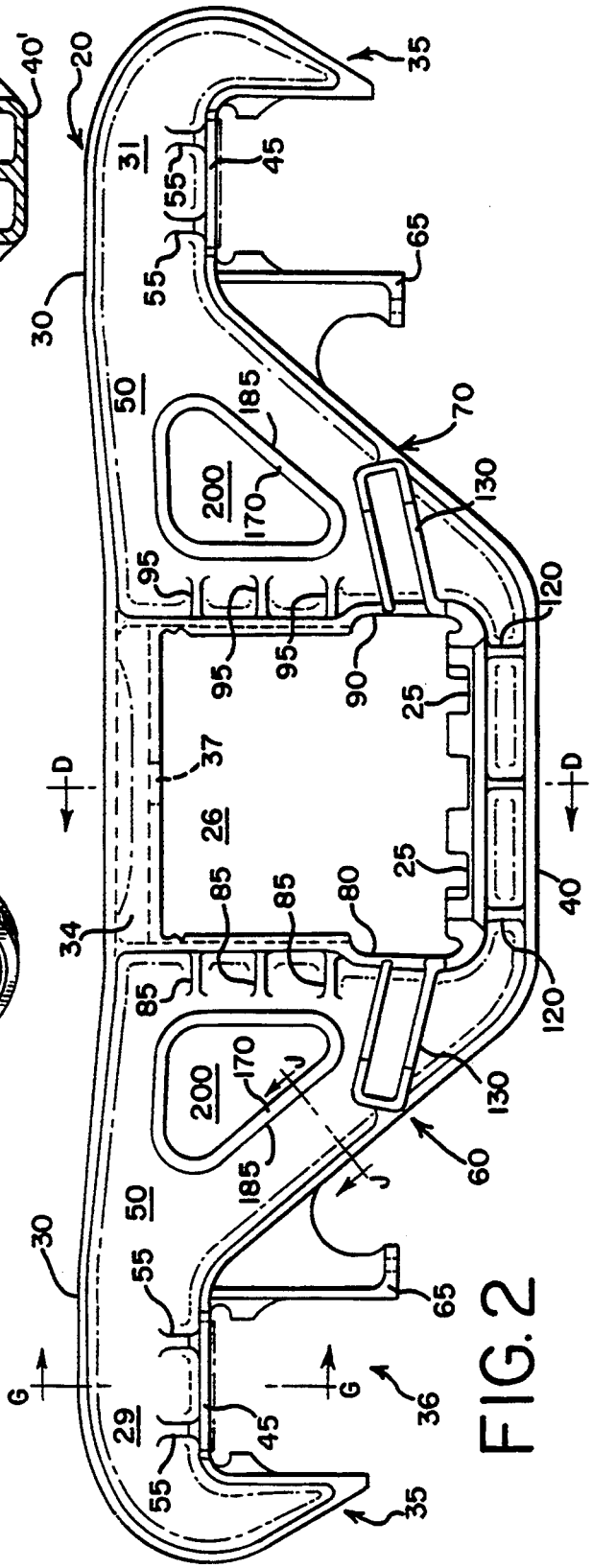
FIG. 2 is a front view of a truck sideframe according to the present invention.
Figure 3:
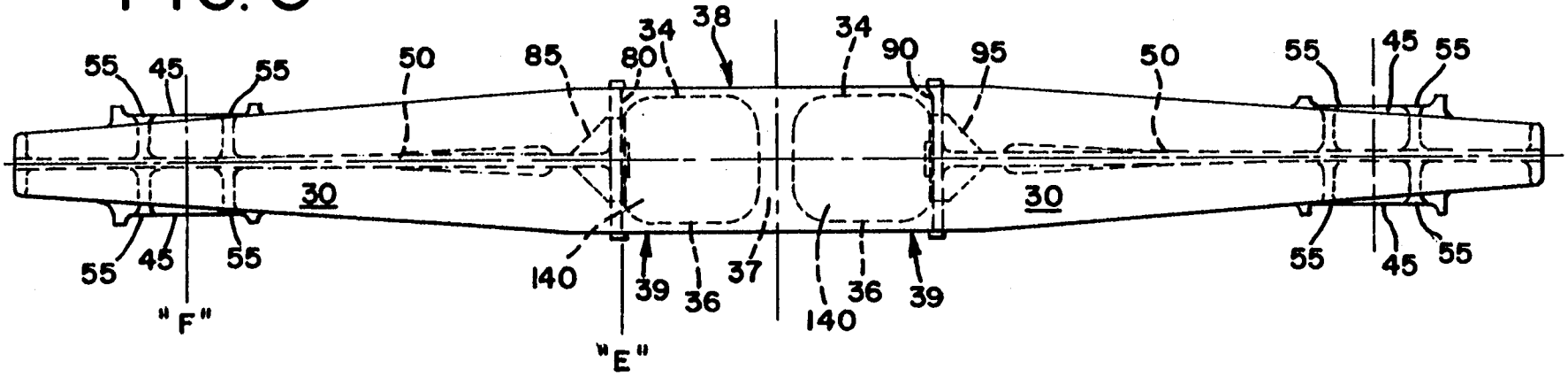
FIG. 3 is a top view of the sideframe of FIG. 1.
Figure 4:
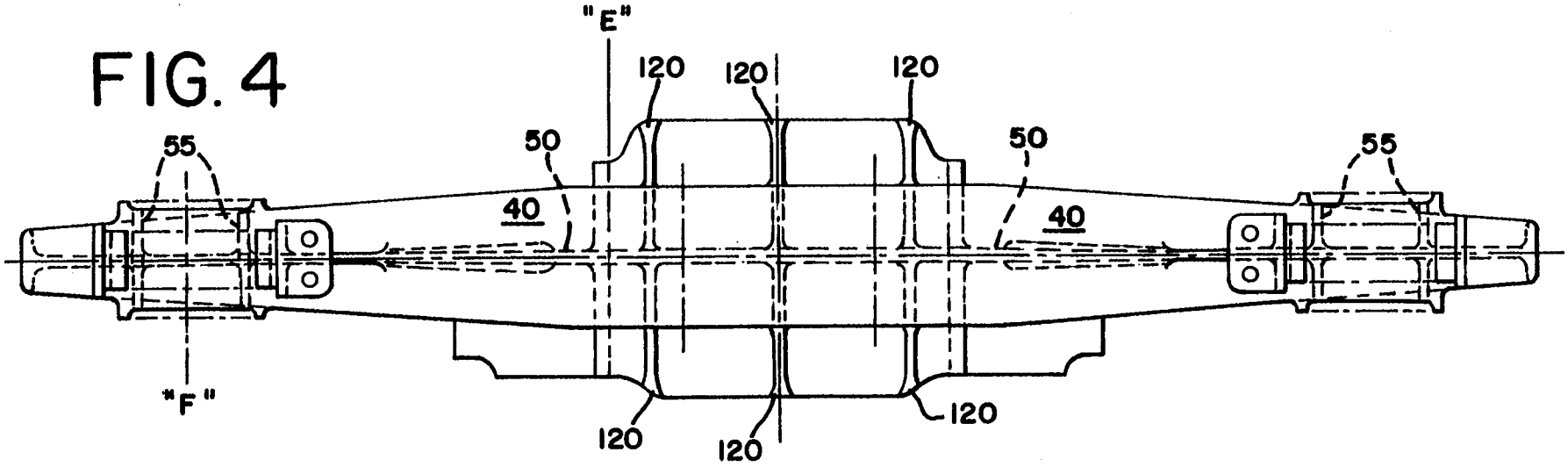
FIG. 4 is a bottom view of the sideframe of FIG. 1.

Since the sideframes 20,24 are identical members, only one of them will be described in greater detail, but before beginning a more detailed description, it should be understood that even though the new sideframe described herein is actually a specially designed I-beam, the commonly recognized sideframe profile is still retained. Referring now to FIGS. 2–4, a sideframe 20 incorporating the features of the present invention is shown and generally comprises a solid upper compression member flange 30 extending lengthwise of truck 10 and a solid lower tension member flange 40, also extending the length of truck 10. Vertical web 50 extends between upper flange 30 and lower flange 40 and connects the upper and lower flanges together, thereby defining the overall structural shape of sideframe 20 as an I-beam. Reviewing FIG. 2 in more detail, it is seen that lower tension member flange 40 has a midsection which is generally parallel to upper compression member 30, and it also has a front and rear section which is comprised of upwardly extending solid diagonal flange sections 60,70 for integrally connecting the lower flange 40 to the upper flange 30 at each sideframe end 29,31. Even though the sideframe flanges are constructed as one continuous flange member, the upper flange experiences compression loading during operation, while the lower flange experiences tensile loading. In prior art sideframes, vertical columns 80,90 were used to directly connect the upper and lower members together in order to add structural support and integrity to sideframe 20; the columns also defined the bolster opening 26. However, in the present design, neither of the vertical columns 80,90 fully extends between the top and bottom members, although they still define the bolster opening. Rather, columns 80 and 90 extend vertically downward from top flange member 30, to spring seat plate 25, thereby forming a center U-shaped structure. Since each of the columns 80,90 are integrally connected to upper flange member 30, the spring seat plate 25 is suspended similar to a simply supported beam having an intermediate load and in order to provide stability and strength to the columns 80,90 and especially the spring seat plate 25, lower support struts 120 directly tie plate 25 to vertical web 50 and lower flange 40. Similarly, column reinforcing ribs 85,95 have been added to columns 80,90 in order to tie the columns to vertical web 50. The function of struts 120 and reinforcing ribs 85,95, will be described in greater detail later.

FIG. 2 also shows that each end 29 and 31 of sideframe 20 also includes a downwardly projecting pedestal jaw 35, respectively depending from each end. It is at the pedestal jaw area where the flange of the top compression member 30 and the flange of the lower tension member 40 are ultimately connected together structurally. Structurally completing the jaw area is the L-shaped bracket member 65 depending downwardly from the pedestal jaw 35. The addition of each of the brackets thereby defines the axle-accommodating pedestal jaw opening 36 in which the axles 18 of the railcar ride. As seen, pedestal jaw roof 45 has pedestal jaw reinforcing gussets 55 for connecting and supporting the jaw roof 45 to the vertical web 50. Also seen in FIG. 2 are the brake beam guides 130. These guides are only found on the inboard side of sideframe 20 and they retain the brake beams used to apply force to wheelsets 12 when stopping the railcar. The guides 130 have a slight downwardly angled horizontal pitch and they connect to the lower tension member diagonal flanges 60,70 on one end and to the vertical columns 80,90 on the other end:. The inboard side of guide 130 is also connected to web 50, thereby adding structural support to the sideframe midsection.

As mentioned, the top flange member 30 is known to undergo compression when the railcar truck is loaded while the bottom flange 40 undergoes a tensile loading. Moreover, it is well known that the very distal ends 29,31 of sideframe 20, namely at the pedestal jaws 35, are the least stressed areas of the sideframe and the forces acting on this area are mainly straight down, static loads, although there is some twisting or dynamic loading, but it's occurrence is infrequent and is usually present only when the truck becomes out of square, as in turning. In order to combat whatever twisting might occur, the pedestal jaw gussets 55 tie the jaws 35 to web 50 and prevent twisting. Furthermore, it is also well known that the center or midsection of the sideframe experiences the greatest magnitude of forces due to the loads transferred from the bolster 16 into the spring set groups. Since each end 29,31 of sideframe 20 is supported by the axles 18 and wheelsets 22, the midsection is effectively suspended between the two ends, making the static and dynamic loading, as well as twisting and bending moments, the greatest in the midsection area of the sideframe. The sideframe midsection therefore has to be structurally stronger than the distal ends 29,31, and the present sideframe has been specifically designed with that in mind. For instance, the cross-sectional thickness of the top flange 30 is continuously about 0.69 inches between the vertical columns 80,90, and it gradually decreases on each side of the bolster opening towards the pedestal jaws, or ends 29, 31, to a final thickness of about 0.50 inches. The thickness of the bottom flange tapers similarly, except that the initial thickness between the columns 80, 90 is continuously 0.75 inches, gradually decreasing to about 0.62 inches at each pedestal jaw or end 29, 31 .

Although I-beam structures are known to offer excellent resistance to static and bending forces, prior art sideframes did not utilize the structure of the present invention where the top and bottom flanges and the vertical web are all solid, cast members. Even though I-beam structures are not particularly suitable for twisting forces, the sideframe of the present design offers additional resistance to twisting forces due to the very nature of the sideframe vertical columns strengthening the I-beam web. As seen in FIG. 3, the vertical web 50 and the vertical columns 80,90 are tied together by the column reinforcing ribs 85,95. Furthermore when viewing FIG. 2–4, it is seen that the lower support struts 120, and the pedestal jaw reinforcing gussets 55 respectfully tie the spring seat plate 25 and the pedestal roofs 45 to the web 50 and to the lower tension member flange 40, as a means for increasing web twisting strength. As illustrated, the lower support struts 120, which are substantially coextensive with the overhang of spring seat plate 25, are thicker and larger than the other reinforcing ribs due to the tremendous bending and twisting stresses the spring groups place on plate 25.

Figure 7:
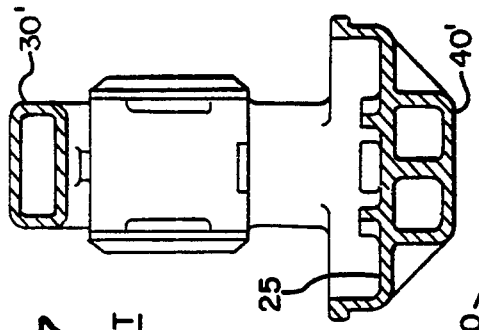
FIG. 7 PRIOR ART
FIG. 7 is a cross-sectional view through a prior art sideframe taken along the reference area defined by line D—D of FIG. 2.
Figure 8:
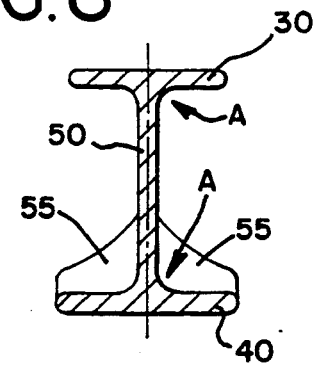
FIG. 8 is a cross-sectional view through the area taken along line G—G of FIG. 2.
Figure 9:
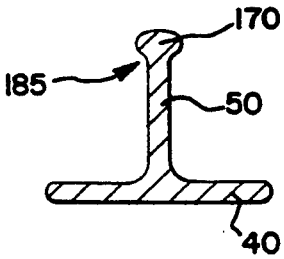
FIG. 9 is a cross-sectional view taken along line J—J of FIG. 2.

The use of the solid vertical web 50 was non-existent in prior art sideframes because the entire sideframe was cast with structural components which had hollow interiors. This point can be best understood by first referring to the line D—D in FIG. 2. If this same reference location was viewed with respect to a cross-section through a prior art sideframe, that prior art sideframe would have the cross-section as shown in FIG. 7, where it is seen that the lower tension member 40' is not a solid flange but is a hollow, tubular structure. This figure also illustrates that the top compression member 30' is also hollow and one in the art would know that the areas inbetween top and bottom members 30' and 40' are also open, including the vertical columns, The open structure of prior art sideframes meant that the prior art structure differed radically from the solid web and solid flange members of the present invention which are best shown in FIG 8. FIG. 8 is a cross-sectional view through pedestal jaw 35, taken along line G—G of FIG. 2, and it shows a single, solid bottom and top member flange connected to vertical web 50 with the intersections being identified as area "A". It is seen that areas "A" are provided with generous radii so that casting will occur smoothly and evenly in order to reduce the stresses which normally accumulate at abrupt sectional changes. The solid flanges and web are seen tied together by gussets 55.

Figure 10:
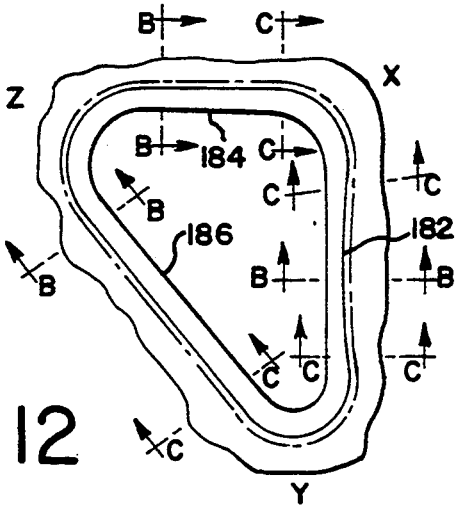
FIG. 10 is a fragmentary side view of the web lightener opening.
Figure 11:
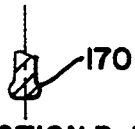
FIG. 11 is a cross-sectional view through lines B—B in FIG. 10.
Figure 12:
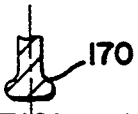
FIG. 12 is a cross-sectional view through lines C—C in FIG. 10.

Referring again to FIG. 2, it is seen that vertical web 50 contains a pair of lightener openings 200 on each end of the sideframe for reducing the weight of the sideframe. Because it is well known that openings act as stress accumulation points, web 50 has been provided with lip 170 around the entire peripheral edge 185 of lightener opening 200 for maintaining a relatively high section modules around the opening. Therefore, lip 170 adds structural strength around lightener opening 200 and to sideframe 20, thereby increasing resistance to fatigue cracking from cyclic flexure stressing. However, as a means for maximizing the section modules while minimizing the metallic mass being added, lip 170 does not remain at a constant cross-sectional thickness around peripheral edge 185. From FIGS. 9–12, it is seen that each lightener opening 200 has a first corner X, a second corner Y, and a third corner Z, all of which are constructed with a consciousness of stress versus weight. By that, it is meant that the lightener opening vertical edge 182 is closer to the midsection of sideframe 20, and experiences more stress than either top horizontal edge 184 or obtuse edge 186. To adequately address these stresses, the corners X,Y, where the greatest stress will accumulate on vertical edge 182, are provided with a substantially heavier lip than at corner Z, where corner Z is the furthest away from the sideframe midsection and the stresses are not as great. As seen from FIG. 10, the corners X and Y have cross-sectional thicknesses designated by sectional lines C—C, while corner Z has a cross-sectional thickness designated by sectional line B—B. In FIGS. 11 and 12 it is seen that lip 170 is larger for a section designated by sectional lines C—C. As a means for saving weight, the corner Z was provided with a smaller cross-sectional area compared to corners X and Y since corner Z experiences smaller loading forces. In addition, vertical edge 182 has also been tapered between corners X and Y, even though each of those corners has the same cross-sectional profiles.

These minute details concerning metallic mass versus localized loading stresses has been carried out all throughout the sideframe design. For example, it is known that the greatest stresses occur at the midsection and become proportionately smaller along the distance to the pedestal jaw; therefore, the entire structure does not have to be as structurally large at ends 29,31 as it does in the midsection. Viewing FIGS. 3 and 4, it is seen that the top and bottom flanges 30,40 have been purposefully designed to neck down or taper, starting from the point near the midsection and the vertical columns 80,90, outward towards the pedestal jaws in a quite extreme fashion in order to save weight. Here, it is seen that top and bottom members 30,40 decrease in width from about 8.5 inches at the midsection, marked "E", to about only 3.75 inches at the pedestal jaw ends, marked "F". Although the midsection width is slightly larger than prior art designs, the distal ends 29,31 have a substantially smaller width, making each of the top and bottom flanges even lighter than an I-beam shaped sideframe constructed according to prior art dimensional specifications.

Figure 6:
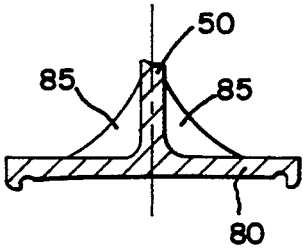
FIG. 6 is a partial top cross-sectional view taken along the line H—H of FIG. 5.

In light of this same recognition, the vertical web 50 has also been constructed to take advantage of weight saving capabilities between the midsection and the distal ends 29,31. Referring to FIG. 6, vertical web 50 is seen to have a cross-sectional thickness of about 0.75 inches at the midsection in the area immediately behind the vertical columns 80,90. In this general area, the web has to structurally handle the large bending and twisting forces which are applied to the sideframe midsection through interaction between the bolster 16 and spring sets 14 and spring seat plate 25. However, it is also seen in FIGS. 3 and 4 that web 50 tapers in cross-sectional thickness from the sideframe midsection at "E", outward towards each of the pedestal jaws 35 at "F", where external forces aren't as great. More specifically, the cross-sectional area of web 50 is only about 0.50 inches at the pedestal jaws 35, whereas the cross-sectional area at the midsection is about 0.75 inches.

Figure 5:
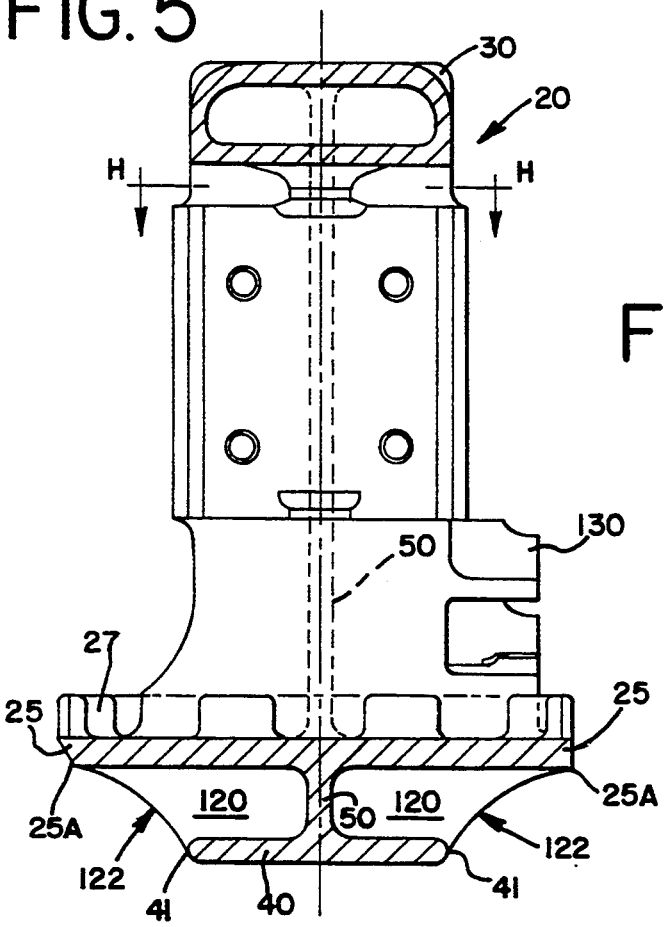
FIG. 5 is a cross-sectional view of the sideframe of FIG. 2, cut along the sideframe midsection at line D—D.

Another area on the sideframe in which metallic mass has been reduced without sacrificing structural strength, is in the area immediately below the spring seat plate 25. Comparing FIGS. 5 and 7, it is evident that the lower tension member flange 40 in FIG. 5 contains far less surface area than a corresponding area as the prior art design of FIG. 7. FIG. 5 shows the lower flange 40 and web 50 integrally mating with spring plate 25 to form an I-beam like structure, with this structure specific to the sideframe midsection. This I-beam like structure uses the spring plate 25 effectively as a top flange, and as seen, this top flange extends laterally beyond the extent of lower flange 40. It is also illustrated here that spring tabs 27 would hold the load bearing spring sets 14 (not shown) at a laterally wider position than the lower flange member 40. In the prior art sideframe shown in FIG. 7, the continuous and hollow, box-like lower tension member structure 40' could substantially handle the bending moments created with the load on the spring sets being outward of the base supporting structure with the braces 125' further preventing the bending of the outer spring plate edges. However, the present design recognizes that since the I-beam design is lighter, those same forces have to be transferred through a slightly thicker spring seat plate in order to remain structurally sound. The three lower support struts 120 prevent bending at spring plate 25 and transfer forces from the plate into the lower tension member 40 and vertical web 50. The lower support struts 120 have a swept back outside edge 122, which interconnects outside spring plate edge 25A to the outside edge 41 of lower flange 40. In this way, further reductions to the structural weight of sideframe 20 can be realized. As seen from FIG. 2, only three lower support struts 120 are used, compared to the four struts typically used in the prior art designs.

The midsection of the upper compression member area which is between the vertical columns 80 and 90 has also been designed for weight reduction. As previously discussed, prior art lower tension members had structural cross-sectional profiles which were closed, box-like, hollow frames and the entire upper compression members had similar structural profiles. However, because the lower midsection of the present invention was structurally reinforced through the addition of lower support struts 120, the structural profile of the upper midsection between the vertical columns also has to be reinforced. When comparing FIGS. 5 and 7, it is seen that the upper flange 30 in FIG. 5 looks very similar to the profile shown in FIG. 7. However, the present invention has an "open" structure so that a visual alley for inspection purposes is provided, while a simultaneous reduction in the metallic mass in this area has been realized. Referring to FIGS. 2 and 3, each outside edge 38,39 of top compression flange 30 has a pair of downwardly depending side panels 34,36, longitudinally extending between columns 80 and 90 and connected to each other at their longitudinal midpoint by cross bar 37. The recess 140 is open and provides clearance for the bolster friction shoes (not shown). Each friction shoe recess 140 extends transversely from side panel 34 to side panel 36 and from vertical column 80,90 to cross-bar 37, making the entire area open. Each of the side panels 34 and 36, and cross-bar 37, adds structural support to the sideframe midsection for further resistance to bending and twisting forces. Prior art sideflames also had the friction shoe recesses, but since the top member was made from a hollow tubular structure, extra weight was added to the sideframe, and the closed, tubular structure also made visual inspection of this area nearly impossible.

The foregoing description has been provided to clearly define and completely describe the present invention. Various modifications may be made without departing from the scope and spirit of the invention, which is defined in the following claims.

What is claimed is:

1. An improved railcar truck sideframe of relatively light weight and open construction for carrying a railcar payload, said sideframe having a longitudinal axis, a front end, a back end and a midsection therebetween, comprising:

a longitudinally elongate solid upper compression member having a first end and a second end, each of said ends including a downwardly projecting pedestal jaw depending therefrom;

a longitudinally elongate solid lower tension member having a front section, a back section and a central section therebetween, said central section generally parallel to said upper compression member, said front section comprising an upwardly extending solid diagonal section and defining a first bend point, said back section comprising an upwardly extending solid diagonal section and defining a second bend point, each of said diagonal sections extending to and connecting with said respective upper compression member ends at a respective pedestal jaw;

a substantially solid vertical web having a pair of sides, said web including an open portion at said sideframe midsection which defines a front vertical column and a rear vertical column and a bolster opening therebetween;

wherein said entire sideframe is of a generally solid, I-beam cross-sectional shape, said I-beam cross-sectional shape defined by a solid, horizontally disposed top flange corresponding to said solid upper compression member, a solid, horizontally disposed bottom flange corresponding to said solid lower tension member, and said substantially solid vertical web interconnecting said upper flange to said lower flange such that an open, I-beam shaped, lightweight sideframe is formed, said top flange, said bottom flange, and said vertical web each having a constant cross sectional thickness between said front and rear vertical columns and a continuously tapering cross sectional thickness from a respective said vertical column to a respective said pedestal jaw, said cross sectional thickness of said vertical web and said bottom flange substantially equal, and said cross sectional thickness of said top flange relatively smaller than said cross sectional thickness of said bottom flange, said top and bottom flanges each having a respective dimensional width of substantially equal extent, wherein said width of each said flange is constant between said front and rear vertical columns and continuously tapers from a respective said vertical column to a respective said vertical jaw, said top and bottom flange width between said vertical columns about twice the width as at said pedestal jaws, said top and bottom flanges also including simple radii curves of fillet material where said respective flange joins said vertical web, said vertical web also includes simple radii curves of fillet material where each respective said vertical column joins said vertical web, said sideframe further including means for reinforcing said vertical web in order to prevent twisting of said web, said reinforcing means vertically attached to each said side of said web at each said pedestal jaw and between said first and second bend points, said vertical web including at least two spaced lightener openings, one of said openings longitudinally disposed an extent forward of said bolster opening and the other of said openings disposed a substantially equal longitudinal extent rearward of said bolster opening.

2. The lightweight sideframe of claim 1, further including a second means for reinforcing said web at each of said front and rear vertical columns, said second means horizontally attached to each said side of said web thereby joining said web to said vertical columns.

3. A relatively lightweight, three-piece railcar truck for carrying a railcar payload, said truck having a longitudinal axis and including a pair of laterally spaced sideframes, each of said sideframes having a front section with a downwardly projecting pedestal jaw, a rear section with a downwardly projecting pedestal jaw, and a midsection, said front and rear pedestal jaws on each said sideframe accepting a respective front and rear wheeled axle, said midsection having a bolster opening defined by a front vertical column and a rear vertical column, each respective sideframe bolster opening accepting a transversely extending bolster therethrough, wherein each of said sideframes is of a generally solid, I-beam cross sectional shape defined by a solid, horizontally disposed top flange, a solid, horizontally disposed bottom flange, and a solid vertical web interconnecting said top and bottom flanges such that an I-beam shaped sideframe is formed, said top flange, said bottom flange, and said vertical web each having a constant cross sectional thickness between said front and rear vertical columns and a continuously tapering cross sectional thickness from a respective said vertical column to a respective said pedestal jaw, said cross sectional thickness of said vertical web and said bottom flange substantially equal, and said cross sectional thickness of said top flange relatively smaller than said cross sectional thickness of said bottom flange, said top and bottom flanges each having a respective dimensional width of substantially equal extent, wherein said width of each said flange is constant between said front and rear vertical columns and continuously tapers from a respective said vertical column to a respective said pedistal jaw, said top and bottom flange width between said vertical columns about twice the width as at said pedestal jaws, said top and bottom flanges also including simple radii curves of fillet material where said respective flange joins said vertical web, said vertical web also including simple radii curves of fillet material where each respective said vertical column joins said vertical web, said sideframe further including means for reinforcing said vertical web in order to prevent twisting of said web, said reinforcing means vertically attached to each said side of said web at each said pedestal jaw and where said vertical columns join said lower flange, said vertical web including at least two spaced lightener openings, one of said openings longitudinally disposed an extent forward of said bolster opening and the other of said openings disposed a substantially equal longitudinal extent rearward of said bolster opening.

4. The lightweight truck of claim 3 further including a horizontally disposed second means for reinforcing said web against twisting, said second means located at each of said front and rear vertical columns on each said web side, said second means joining each said web side to a respective said vertical column.

* * * * *